United States Patent [19]

Dahlgren

[11] Patent Number: 5,012,624

[45] Date of Patent: May 7, 1991

[54] METHOD AND APPARATUS FOR INSTALLING WIRE ANCHORS FOR SUSPENDED CEILINGS

[76] Inventor: Steven W. Dahlgren, 7226 W. Sierra St., Peoria, Ariz. 85345

[21] Appl. No.: 367,967

[22] Filed: Jun. 19, 1989

[51] Int. Cl.[5] ..... E04B 9/18

[52] U.S. Cl. ..... 52/484; 81/124.2

[58] Field of Search ..... 411/387, 368, 369, 533, 411/400, 401; 52/484; 81/124.2; 29/240, 270, 271, 278

[56] References Cited

U.S. PATENT DOCUMENTS

| | | | |
|---|---|---|---|
| 882,937 | 3/1908 | Fegley | 81/124.2 |
| 1,965,360 | 7/1934 | Steinway | 411/401 X |
| 2,231,323 | 2/1947 | Cawood | 81/124.2 X |
| 3,882,756 | 5/1975 | Sauer | 411/387 |
| 4,473,984 | 10/1984 | Lopez | 411/400 X |
| 4,764,069 | 8/1988 | Reinwall | 411/401 X |

FOREIGN PATENT DOCUMENTS

| | | | |
|---|---|---|---|
| 2916638 | 11/1980 | Fed. Rep. of Germany | 52/484 |
| 332397 | 10/1903 | France | 411/400 |
| 402346 | 5/1966 | Switzerland | 52/484 |
| 560954 | 8/1977 | U.S.S.R. | 52/484 |

*Primary Examiner*—David A. Scherbel
*Assistant Examiner*—Jerrold D. Johnson
*Attorney, Agent, or Firm*—Tod R. Nissle

[57] ABSTRACT

A system for suspending a structural member from a ceiling. The ceiling includes a metal panel member. The system includes a wire having one end connected to the structural member. The wire extends upwardly from the structural member to an anchor member. The upper end of the wire is attached to the anchor member. The anchor member is installed in the metal panel member in a continuous operation which utilizes a single tool assembly to perform a continuous sequence of steps.

2 Claims, 2 Drawing Sheets

5012624

METHOD AND APPARATUS FOR INSTALLING WIRE ANCHORS FOR SUSPENDED CEILINGS

This invention relates to a method and apparatus for suspending a structural member from the ceiling of a building.

More particularly, the invention pertains to apparatus for suspending a structural member from a metal ceiling panel, the apparatus enabling the metal panel to be pierced to form an aperture through the panel, an anchor to be affixed to the metal panel through the aperture, and a wire to be secured to the anchor, all in a continuous sequence of steps utilizing a single installation tool.

Modern day office building are often equipped with suspended secondary ceilings. A suspended secondary ceiling includes a horizontally oriented skeletal support structure or lattice of elongate interconnected members. The interconnected members define square openings which support acoustical tile placed in the openings. The skeletal support structure is suspended beneath a primary ceiling by vertically oriented wires which interconnect the support structure and the primary ceiling. The suspension wires are attached to L-shaped brackets which are secured to the primary ceiling. When the primary ceiling is comprised of strips or of panels of metal, the L-shaped brackets are attached to the primary ceiling with screws. The screws thread through the L-shaped brackets into a hole drilled in the metal. The use of such L-shaped brackets to anchor ceiling suspension wires utilizes relatively inexpensive hardware, comprises a simple operation, and provides a secure anchor for ceiling suspension wires. Installation of the brackets is, however, labor intensive. The installation requires three separate operations: drilling a hole in the primary ceiling, inserting a screw in the hole to anchor the L-shaped bracket adjacent the primary ceiling, and attaching one end of a suspension wire to the L-shaped bracket. Repeating these three steps hundreds of times during the installation of a suspended ceiling rapidly becomes an expensive proposition.

Accordingly, it would be highly desirable to provide an improved method and apparatus for suspending acoustical tile and other structures from the primary ceiling of a room in a building structure.

It would also be highly desirable to provide an improved method for anchoring a suspension wire to a metal panel in the primary ceiling of a room, the improved method enabling the suspension wire to be anchored to the ceiling in a single operation comprising a continuous sequence of steps.

Therefore, it is a principal object of the invention to provide an improved method and apparatus for anchoring suspension wires to the primary ceiling of a building.

Another object of the invention is to provide a method and apparatus for anchoring a suspension wire in a metal panel in the primary ceiling of a building, the method and apparatus enabling the suspension wire to be secured to the ceiling in a continuous operation utilizing a single manually controlled tool assembly.

A further object of the invention is to provide improved apparatus which anchors a suspension wire in a metal panel in a primary ceiling and which distributes the weight borne by the suspension wire over a greater than normal area of the metal ceiling panel.

Still another object of the invention is to provide improved apparatus of the type described, which, when anchoring a suspension wire in a metal ceiling panel, alters the shape of the panel to improve the effectiveness of the panel in securely anchoring the suspension wire.

These and other, further and more specific objects and advantages of the invention will be apparent to those skilled in the art from the following detailed description thereof, taken in conjunction with the drawings in which.

Briefly, in accordance with my invention, I provide an improved system for suspending a structural member from a ceiling. The ceiling includes a metal panel. The improved system includes a secondary aperture formed through the metal panel; an elongate member including a first end positioned below the ceiling and, a second end having a distal tip and having a threaded portion, the threaded portion contacting the secondary aperture, having an inner thread diameter and having an outer thread diameter; drill means attached to the distal tip, the drill means being shaped and dimensioned to drill, when rotated and pressed against the metal panel, a primary aperture through the panel having a diameter at least ten percent less than the inner thread diameter of the second end such that when the threaded portion of the second end is turned through the primary aperture, the portion of the metal panel adjacent the primary aperture is upwardly deformed from the metal panel and away from the first end of the threaded member to enlarge the primary aperture to form the secondary aperture to permit the threaded portion to turn into and contact the secondary aperture; an elongate horizontally orientated support member having one end connected to the first end of the anchor member and having another end connected to the structural member; and, a collar member. The collar member is attached to the anchor member intermediate the first and second ends; outwardly extends from the anchor member; and, contacts the ceiling. The collar member prevents the anchor member from being turned further into the secondary aperture.

Figure 1:
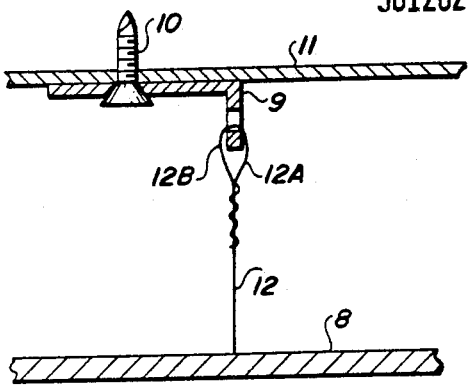
FIG. 1 (PRIOR ART)
FIG. 1 is side sectional elevation view illustrating prior art apparatus for connecting a suspension wire to the primary ceiling of a building structure.
Figure 3:
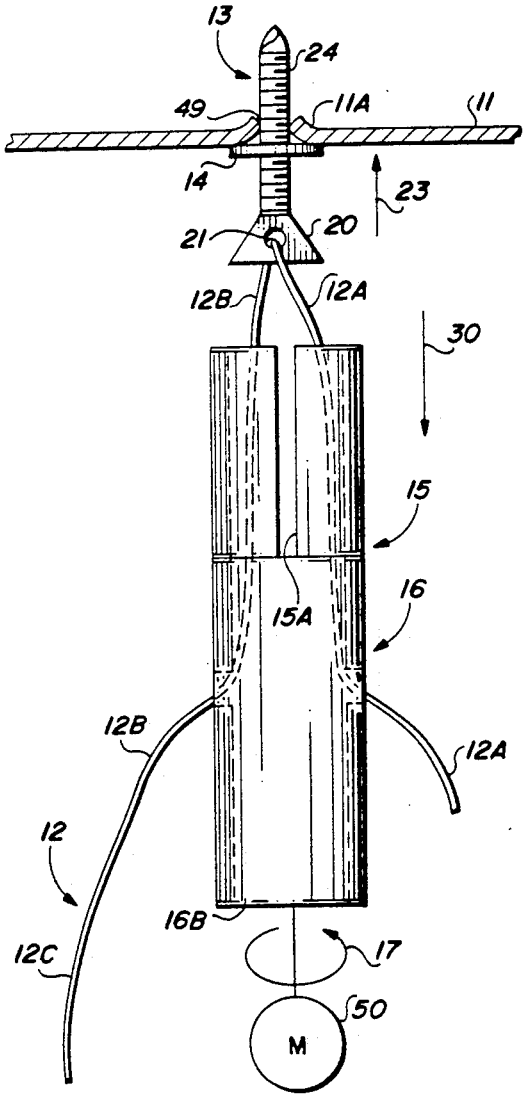
FIG. 3 is side elevation view illustrating the mode of operation of the apparatus of FIG. 2.
Figure 2:
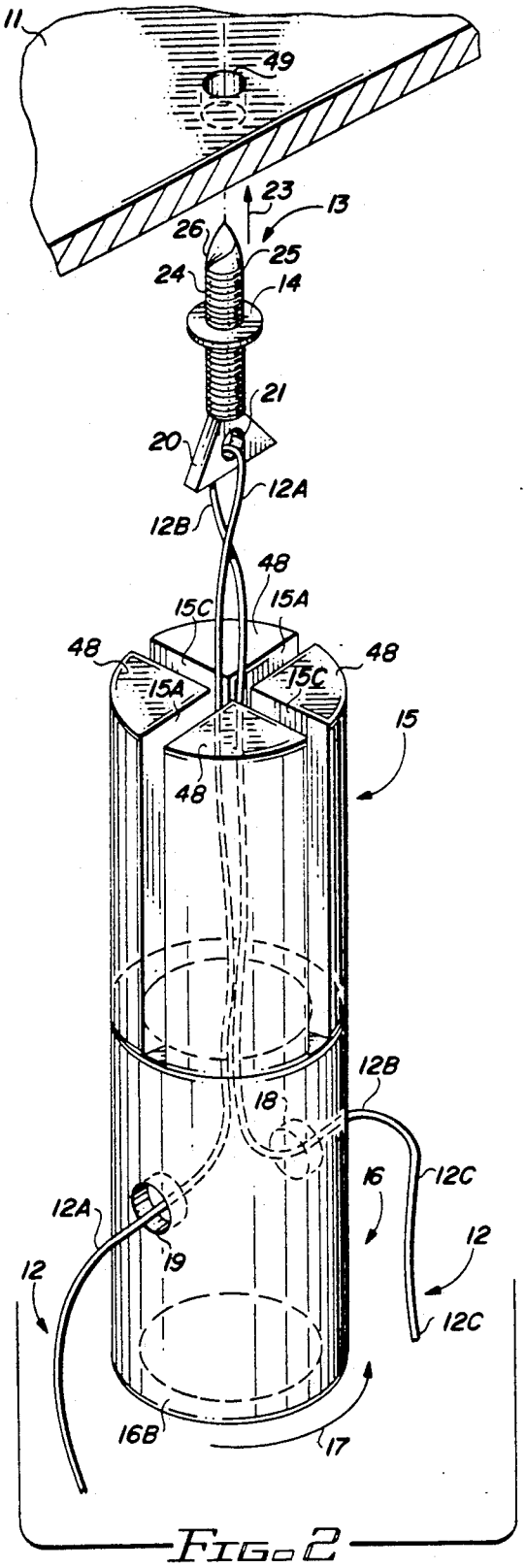
FIG. 2 is a is a perspective view illustrating apparatus constructed in accordance with the principles of the invention.
Figure 4:
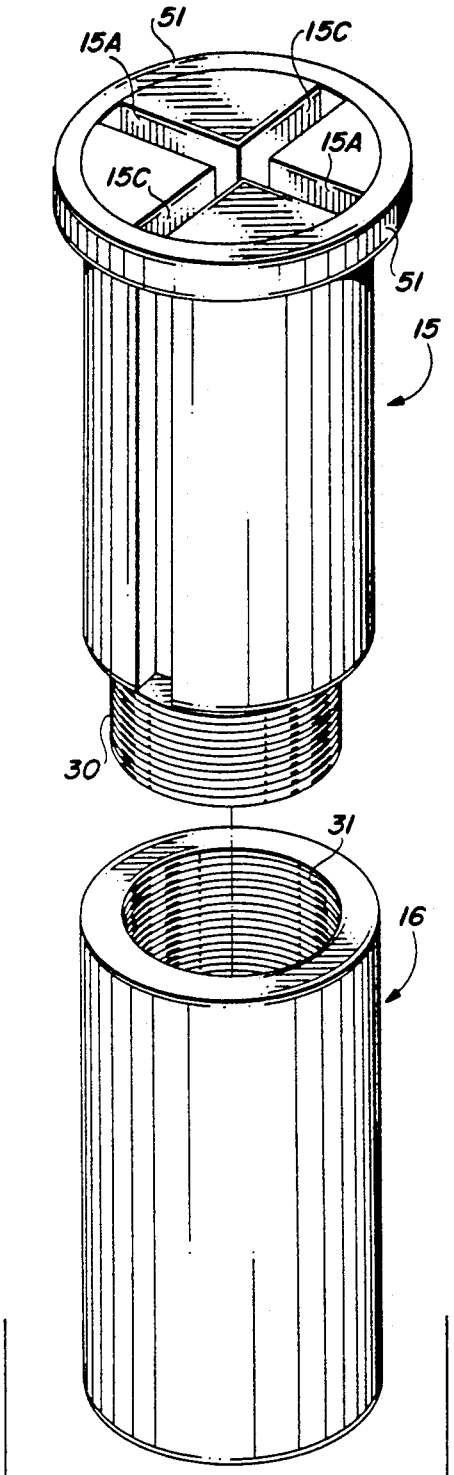
FIG. 4 is a perspective view of a portion of the apparatus of FIG. 3 illustrating further construction details thereof; and, FIG. 5 is a perspective view illustrating an alternate embodiment of apparatus used in the practice of the invention.

Turning now to the drawings, which depict the presently preferred embodiments of the invention for the purpose of illustrating the practice thereof and not by way of limitation of the scope of the invention and in which like reference characters represent corresponding elements throughout the several views, FIG. 1 illustrates prior art apparatus for anchoring a suspension wire 12 to a metal panel primary ceiling member 11. Screw 10 extends through an opening formed in bracket 9 and is turned through an aperture in metal panel member 11 to secure bracket 9 adjacent ceiling member 11. The upper end of suspension wire 12 is attached to bracket 9. The lower end of wire 12 is attached to structural member 8. Member 8 can comprise a portion of an air duct, of the lattice frame work for supporting and carrying a plurality of acoustical ceiling tiles, of a conduit for carrying water or electrical wiring, etc. The presently preferred embodiment of the invention is illustrated in FIGS. 2 to 4 and includes elongate anchor member 13 and a tool assembly utilized to install anchor member 13 in a metal ceiling panel 11. The tool member includes upper cylindrical portion 15 and lower cylindrical portion 16. Panel member 11 typically comprises a relatively thin sheet of aluminum or of zinc-coated steel, and can have a thickness comparable to that found in corrugated metal roofing or in the rectangular ducting used in residential air conditioning systems. When desired, thicker panels 11 of metal can be utilized. Anchor member 13 includes first end 20, second threaded end 24 and collar member 14. Threaded end 24 includes distal tip 25. Drill 26 is fixedly secured to distal end 25. Aperture 21 is formed through first end 20. Upper portion 15 includes perpendicular slots 15A and 15C, each sized to slidably receive first end 20. Lower portion 16 is hollow and includes spaced apart opposed apertures 18 and 19 formed through the cylindrical wall thereof. As shown in FIG. 4, upper portion 15 is provided with a hollow externally threaded end 30 sized to be turned into the internal threads 31 of lower portion 16.

As is depicted in FIG. 2, the upper end of wire 12 includes portion 12A connected to portion 12B. Portion 12B is also connected to the lower end or portion 12C of wire 12. Portion 12B is connected to portion 12A at aperture 21. Portion 12A extended downwardly from aperture 21 through slot 15C into lower portion 16, and out of portion 16 through aperture 19. Portion 12B extends downwardly from aperture 21 through slot 15C, into lower portion 16 and outwardly through aperture 18. As illustrated in FIG. 3, means 50 are provided for rotating portions 15 and 16 in the direction of arrow 17. Since upper portion 15 and lower portion 16 are securely interconnected, they rotate simultaneously in the direction of arrow 17.

In use, end 20 in FIG. 2 is slid into slot 15A until upper surface 48 of portion 15 contacts collar member 14. Portions 15 and 16, along with anchor member 13 are upwardly displaced in the direction of arrow 23 until the tip of drill 26 is pressed against metal panel member 11. Portions 15 and 16 are rotated in the direction of arrow 17, which causes drill 26 to rotate simultaneously with portion 15 and to cut member 11 to form an aperture 49 therethrough. The diameter of aperture 49 is at least 10 percent less than the inner diameter of the threads on second end 24 of anchor member 13. Consequently, after aperture 49 is formed and portions 15 and 16 and member 13 continue to rotate in the direction of arrow 17 the portion 11A of member 11 which circumscribes and is immediately adjacent aperture 49 is upwardly displaced in the manner illustrated in FIG. 3. The upward displacement of portion 11A enlarges aperture 49 to form a secondary aperture The enlargement of aperture 49 is necessary in order for second end 24 to turn through aperture 49 in the manner illustrated in FIG. 3. The upward displacement or deformation of portion 11*a* serves several functions. In addition to enlarging aperture 49, the upward displacement of portion 11A makes it more difficult for anchor member 13 to be pulled downwardly through aperture 49 in the direction indicated by arrow 30. Further, the upward displacement of portion 11A tends to work to harden and strengthen portion 11A.

To obtain the upward displacement of portion 11A illustrated in FIG. 3, it is important that drill 26 produce an aperture 49 having a diameter which is significantly less than the inner diameter of the threaded portion of anchor member 13 which engages enlarged aperture 49 in FIG. 3. The diameter of aperture 49 is ten to fifty percent less than the inner diameter of the thread engaging enlarged aperture 49 in FIG. 3.

After motor 50 rotates portions 15 and 16 and anchor member 13 in the direction of arrow 17 to insert member 13 in panel member 11 in the position illustrated in FIG. 3, portions 15 and 16 are pulled downwardly in the direction of arrow 30 free from first end 20 to the position illustrated in FIG. 3. In FIG. 3, collar member 14 prevents anchor member 13 from being turned into enlarges aperture 14 any further in the direction of arrow 23. After portions 15 and 16 are downwardly displaced from end 20 to the position illustrated in FIG. 3, portions 15 and 16 are again rotated in the direction of arrow 17 to twist wire portions 12A and 12B about one another, in the manner illustrated in FIG. 1. After portions 12A and 12B are twisted about one another, the rotation of portions 15 and 16 is halted, and portions 15 and 16 are pulled downwardly in the direction of arrow 30. Wire 12 slides through apertures 18 and 19 and portions 15 and 16 are pulled free from wire 12 when portions 15 and 16 are downwardly displace a sufficient distance in the direction of arrow 30.

Motor 50 typically comprises a hand drill adapted to engage portion 16 at points on the bottom 16B thereof. In the alternative, portions 15 and 16 can, when possible, be manually rotated or can be rotated by any other appropriate means known in the art. A variety of motor and/or gearing arrangements can be attached to and used to rotate portion 16.

In order to ensure that wire portions 12A and 12B remain in slot 15C (or 15A) during the utilization of sections 15 and 16 a collar 51 can be attached to the upper end of portion 15 in the manner illustrated in FIG. 4.

Figure 5:
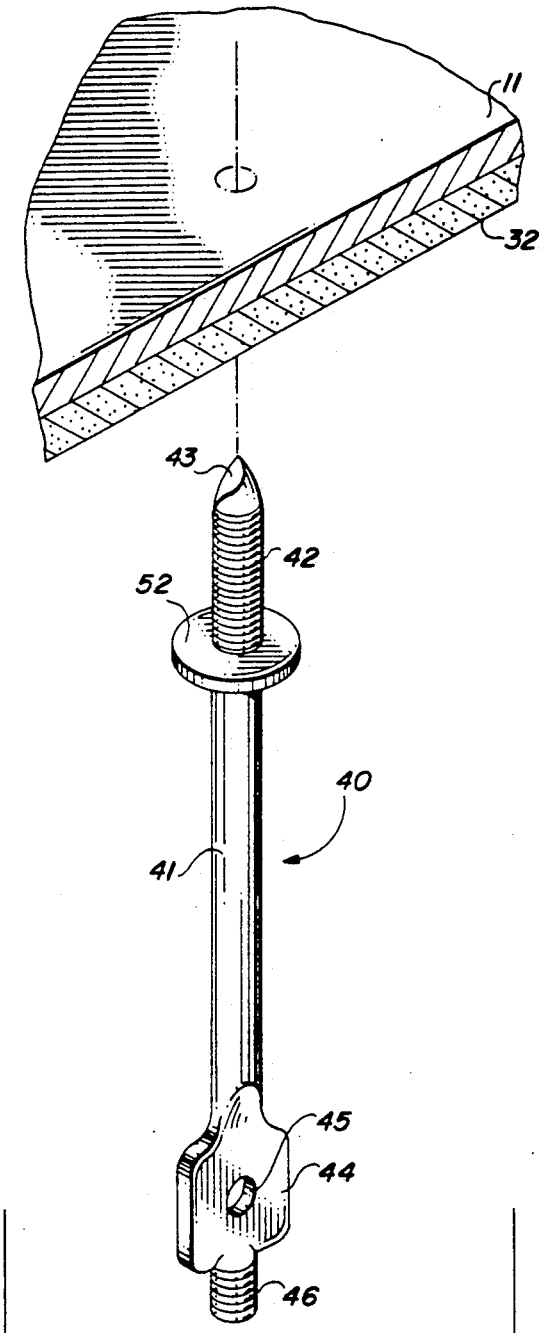

An alternate anchor member which can be used in the practice of the invention is illustrated in FIG. 5. Anchor member 40 includes first end 44, second end 42, drill 43 attached to the distal tip of second end 42, collar member 52 fixedly attached to intermediate portion 41, and aperture 45 formed through end 44. Threaded portion 46 is attached to end 44. An elongate rod having at least one internally threaded end can be utilized in place of wire 12. When such a rod is used, the internally threaded end is sized to be turned onto threaded portion 46. The other end of the rod is attached to a structural member 8.

The apparatus of the invention can be utilized to suspend structural members 8 from a ceiling comprised solely of metal panel members 11. Members 11 can each consist of one elongate side or leg of a U-shaped metal beam used in a ceiling. Or, a ceiling maybe comprised of a single large rectangular or square metal panel member 11. A metal panel member 11 can be used in a ceiling which includes plasterboard 32 beneath (FIG. 5) and/or above panel member 11. A metal panel member 11 can be otherwise sandwiched in a ceiling including layers of plasterboard, wood, foam, or other materials. Regardless of whether plasterboard 32 or other auxiliary material are utilized in a ceiling along with metal panel member 11, the principle of the invention remains the same.

That is, drill 26, even though it may cut through plasterboard or other auxiliary materials, always cuts an aperture 49 through metal panel member 11, which aperture 49 is enlarged when threaded portion 24 (FIG. 2) is turned into aperture 49.

Collar member 14 need not completely circumscribe threaded portion 24 in FIG. 2. Collar member 14 can have any shape and dimension as long as it functions to abut member 11 in the manner illustrated in FIG. 3 to prevent anchor member 13 from being turned further into and through enlarged aperture 49.

Having described my invention in such terms as to enable those skilled in the art to understand and practice it, and having identified the presently preferred embodiments thereof, I claim:

1. A system for suspending a structural member from a ceiling, said ceiling including a metal panel, said system including (a) a secondary aperture formed through said metal panel;

(b) an elongate anchor member including (i) a first end positioned below said ceiling and having a contact surface and a wire receiving aperture formed through said first end, (ii) a second end having a distal tip and a threaded portion, said threaded portion
contacting said secondary aperture,
having an inner threaded diameter, and
having an outer threaded diameter, and (iii) a shaft extending intermediate and connected to said first end and said second end;

(c) drill means attached to said first end to rotate said anchor member and said distal tip, said distal tip being shaped and dimensioned to drill, when rotated and pressed against said metal panel, a primary aperture through said panel having a diameter at least ten percent less than said inner thread diameter such that when said threaded portion is turned through said primary aperture, the portion of said metal panel adjacent said primary aperture is outwardly deformed from said metal panel and away from said first end of said anchor member to enlarge said primary aperture to form said secondary aperture to permit said threaded portion to turn into and contact said secondary aperture, said drill means including (i) an elongate torque member having at least one radial slot shaped and dimensioned to slidably removably receive said first end to engage said contact surface and rotate said anchor member to cause said distal tip to drill said primary aperture when said torque member is rotated, and (ii) means for rotating said torque member;

(d) an elongate vertically oriented support member having one end connected to said first end of said anchor member and having another end connected to said structural member; and, (e) a collar member (i) attached to said shaft of said anchor member intermediate said first and second ends, (ii) outwardly extending from said shaft, and (iii) contacting said ceiling, said collar member preventing said anchor member from being turned further into said secondary aperture.

2. A system for installing an anchor in a metal panel in a ceiling, said system including (a) a secondary aperture formed through said metal panel;

(b) a unitary elongate anchor--hanger member including (i) a first end positioned below said ceiling and having a contact surface and a wire receiving aperture formed through said first end, and (ii) a second end having a distal tip and a threaded portion, said threaded portion
contacting said secondary aperture,
having an inner thread diameter, and
having an outer thread diameter;

(c) an elongate wire extending through said wire receiving aperture and having first and second portions (i) interconnected at said aperture, (ii) each having a distal end, and (iii) each extending outwardly away from said aperture and said anchor--hanger member in opposed relationship;

(d) a collar member (i) attached to said anchor--hanger member intermediate said first and second ends, (ii) outwardly extending from said anchor--hanger member, and (iii) contacting said ceiling, said collar member preventing said anchor--hanger member from being turned further into said secondary aperture;

(e) drill means attached to said first end of said anchor--hanger member to rotate said anchor--hanger member and said distal tip, said distal tip being shaped and dimensioned to drill, when rotated and pressed against said metal panel, a primary aperture through said panel having a diameter of at least ten percent less than said inner thread diameter such that when said threaded portion is turned through said primary aperture, the portion of said metal panel adjacent said primary aperture is outwardly deformed from said metal panel and away from said first end of said anchor--hanger member to enlarge said primary aperture to form said secondary aperture to permit said threaded portion to turn into and contact said secondary aperture, said drill means including (i) an elongate torque member having at least one radial slot shaped and dimensioned to slidably removably receive said first end to engage said contact surface and rotate said anchor--hanger member to cause said distal tip to drill said primary aperture when said torque member is rotated, (ii) means for rotating said torque member, (iii) a hollow formed through said torque member to slidably removably receive said first and second portions of said wire such that when said slot receives said contact surface and said torque member rotates said anchor--hanger said first and second portions of said wire rotate simultaneously with said anchor member and said torque member, and when said torque member turns said threaded portion into said secondary aperture until said collar member contacts said ceiling and said torque member is pulled free from said first end and said first and second portions of said wire remain in said hollow, rotating said torque member causes said first and second portions to twist around one another to secure said wire in said first end of said anchor--hanger member.

* * * * *